US008899140B2

(12) United States Patent
Chiappini et al.

(10) Patent No.: US 8,899,140 B2
(45) Date of Patent: Dec. 2, 2014

(54) SYSTEM FOR EVACUATING CARTRIDGES

(75) Inventors: Andrea Chiappini, La Spezia (IT); Andrea Bruschi, La Spezia (IT)

(73) Assignee: OTO Melara S.p.A., La Spezia (IT)

( * ) Notice: Subject to any disclaimer, the term of this patent is extended or adjusted under 35 U.S.C. 154(b) by 143 days.

(21) Appl. No.: 13/165,413

(22) Filed: Jun. 21, 2011

(65) Prior Publication Data

US 2011/0308127 A1 Dec. 22, 2011

(30) Foreign Application Priority Data

Jun. 22, 2010 (IT) ..... TO2010A0535

(51) Int. Cl.
*F41A 9/39* (2006.01)
*F41A 9/14* (2006.01)
*F41A 9/56* (2006.01)

(52) U.S. Cl.
CPC ... *F41A 9/14* (2013.01); *F41A 9/39* (2013.01); *F41A 9/56* (2013.01)
USPC ..... 89/46; 42/33

(58) Field of Classification Search
CPC ..... F41A 15/12; F41A 15/14; F41A 15/16; F41A 9/38; F41A 9/39; F41A 9/40; F41A 9/41
USPC ..... 89/33.03, 45, 46, 47, 33.02, 33.05; 42/25, 32, 33
See application file for complete search history.

(56) References Cited

U.S. PATENT DOCUMENTS

| | | | | |
|---|---|---|---|---|
| 3,690,216 | A * | 9/1972 | Brint | 89/33.05 |
| 4,244,270 | A | 1/1981 | Tassie | |
| 5,111,732 | A * | 5/1992 | Marcon et al. | 89/135 |
| 5,563,363 | A * | 10/1996 | Soulaigre et al. | 89/46 |
| 5,675,924 | A | 10/1997 | Predazzer | |
| 6,457,397 | B1 | 10/2002 | Guesnet et al. | |

FOREIGN PATENT DOCUMENTS

GB 217569 9/1924

OTHER PUBLICATIONS

Italian Search Report for Application No. TO20100535 mailed Feb. 17, 2011.

* cited by examiner

*Primary Examiner* — Stephen M Johnson
(74) *Attorney, Agent, or Firm* — Merchant & Gould P.C.

(57) ABSTRACT

A system is for evacuating cartridges, applied to a firearm 1. The firearm includes a breech 14, a firing chamber 12 in which the projectile that will come out through a barrel 13 is fired. The evacuation system includes an evacuation tray 2, adapted to receive the cartridge following deflagration of an ammunition, and a movement mechanism 3, adapted to move the tray 2. The movement mechanism 3 turns the evacuation tray 2 about an axis "X", parallel to the axis of the barrel 13 of the firearm 1, in a preset and appropriately cadenced way, passing from a first position, where the cartridge is received, to a second position, where the cartridge is expelled by the expulsion mechanism 5, and vice versa.

8 Claims, 5 Drawing Sheets

SYSTEM FOR EVACUATING CARTRIDGES

This application claims benefit of Serial No. TO 2010 A 000535, filed 22 Jun. 2010 in Italy and which application is incorporated herein by reference. To the extent appropriate, a claim of priority is made to the above disclosed application.

BACKGROUND

The present invention refers to a system for evacuating cartridges from the powder chamber or firing chamber of a firearm, normally a cannon, preferably in the direction of a system for expelling cartridges, following upon deflagration of an ammunition.

The ammunition is essentially made up of a cartridge containing the gun powder for the deflagration of the ammunition, and a projectile which is fired by the firearm towards the target.

Such projectiles can be "intelligent", i.e., comprising a target identifying and targeting system, which is capable of varying the direction of the projectile itself after being shot.

Normally, a system for evacuating cartridges comprises an evacuation tray that is adapted to receive the cartridge subsequent to the firing of the ammunition.

Such a tray is normally positioned in axis with the barrel of the firearm so as to be able to receive the cartridge. Subsequently, such a tray, through a movement mechanism, is moved so as to allow the cartridge to be definitively expelled.

Such movement systems are normally slow, reducing the shooting frequency of the firearm, and they are also unstable, since especially in critical conditions, for example, if applied to a ship, in conditions of sea force 6 and more, they often risk to jam the whole firearm since they are not able to carry out their task.

Moreover, normally, such mechanisms for evacuating cartridges are not provided with safety systems which can avoid incidents between movement mechanism and the loading mechanism in the case of malfunctioning, for example of the movement mechanism.

SUMMARY

The present invention proposes to solve such technical drawbacks by making a system for evacuating cartridges that is stable, even in extreme conditions, allowing cartridges to always be expelled by the firing chamber.

Such a system, moreover, reduces the probability of collisions and incidents between the various mechanisms in the case of malfunction of the parts.

One aspect of the present invention concerns a system for evacuating cartridges in a firearm that is capable of speeding up the time necessary to carry out such an operation, thus making it possible to increase the frequency with which the firearm itself is fired.

A further aspect of the present invention concerns a safety device that is capable of avoiding collisions between the evacuation system and various mechanisms or systems applied in a firearm.

BRIEF DESCRIPTION OF THE DRAWINGS

The characteristics and the advantages of such a system for evacuating cartridges shall become clearer from the following description of an embodiment with reference to the attached figures, which specifically illustrate.

DETAILED DESCRIPTION

Figure 1:
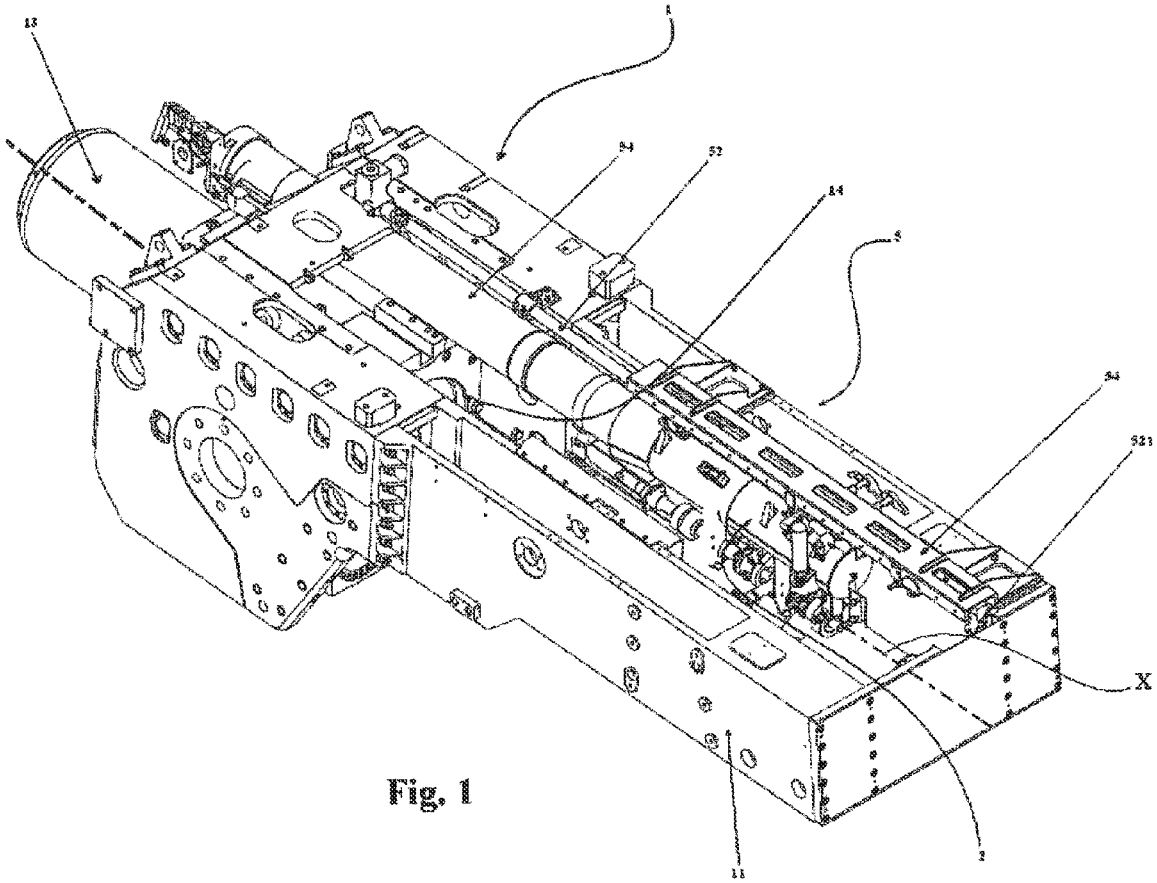
FIG. 1 shows the structure of the firearm in which such a system for evacuating cartridges, according to the present invention, is applied.
Figure 2:
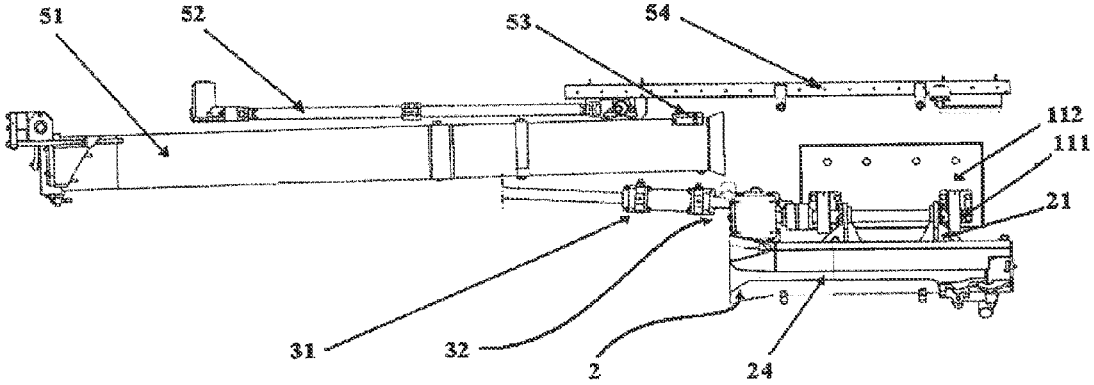
FIG. 2 illustrates in detail the system according to the present invention, from a side view.
Figure 3:
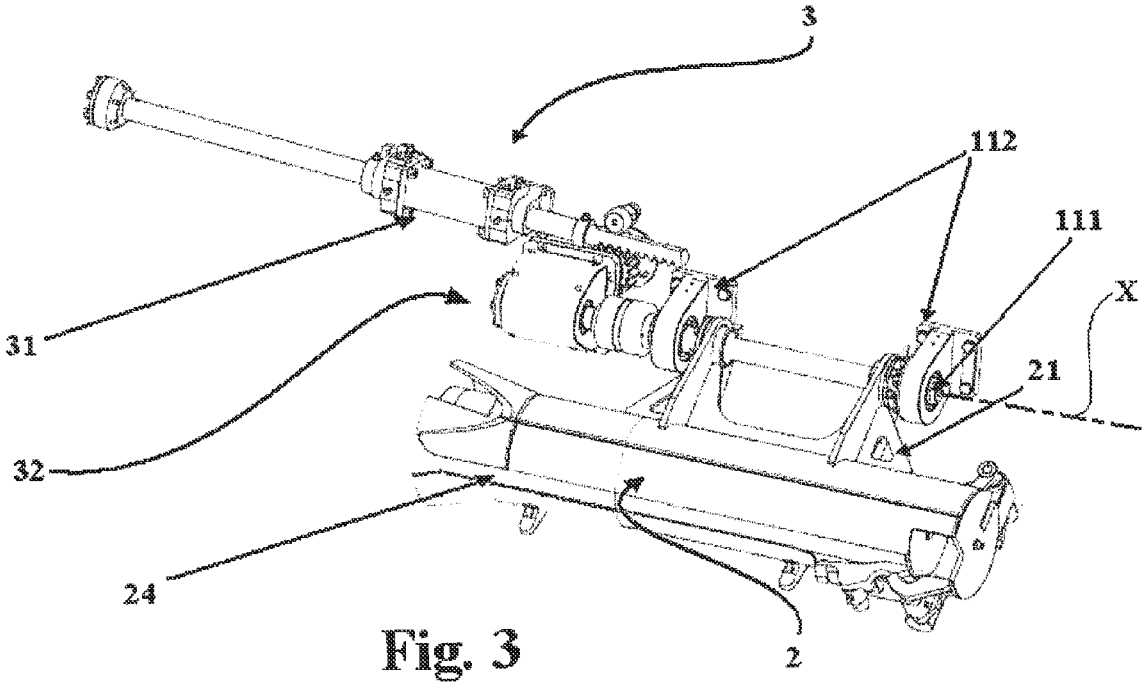
FIG. 3 illustrates the movement mechanism of the tray according to the present invention.

With reference to the mentioned figures, the system for evacuating cartridges is applied to a firearm 1 that typically comprises a breech 14, a firing chamber 12 in which the projectile is fired, coming out of a barrel 13.

Such an evacuation system, enclosed in a box-type protective structure 11, comprises an evacuation tray 2, adapted to receive the cartridge following upon deflagration of an ammunition, and a movement mechanism 3 adapted to move such a tray 2.

Such a system for evacuating cartridges is characterised in that movement mechanism 3, is a double acting mechanism, i.e. it allows tray 2 to rotate about an axis "X", that is parallel to the axis of barrel 13 of firearm 1, to reach an expulsion mechanism 5 for definitively expelling the cartridge and the subsequent return; such a rotation makes it possible to evacuate the cartridge, simultaneously with the loading of an ammunition inside firing chamber 12 by a loading mechanism.

Such a system for evacuating cartridges further comprises a safety mechanism adapted to move tray 2 in the case in which movement mechanism 3 malfunctions.

Such a safety mechanism prevents onset of damage consequent upon the impact of tray 2 with the loading mechanism, adapted to insert new ammunition into firing chamber 12.

Figure 4:
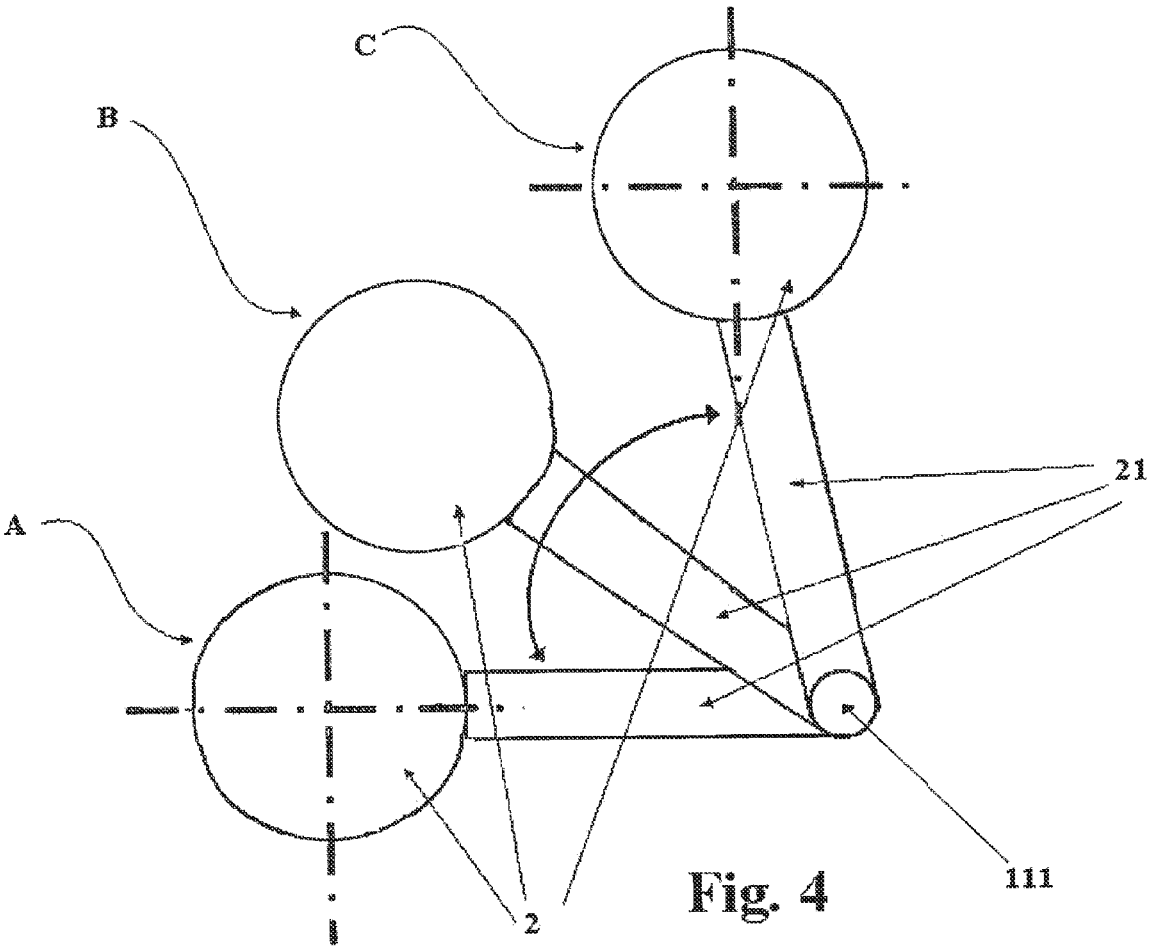
FIG. 4 shows a schematic diagram of the positions that the system can take up when moving.
Figure 5:
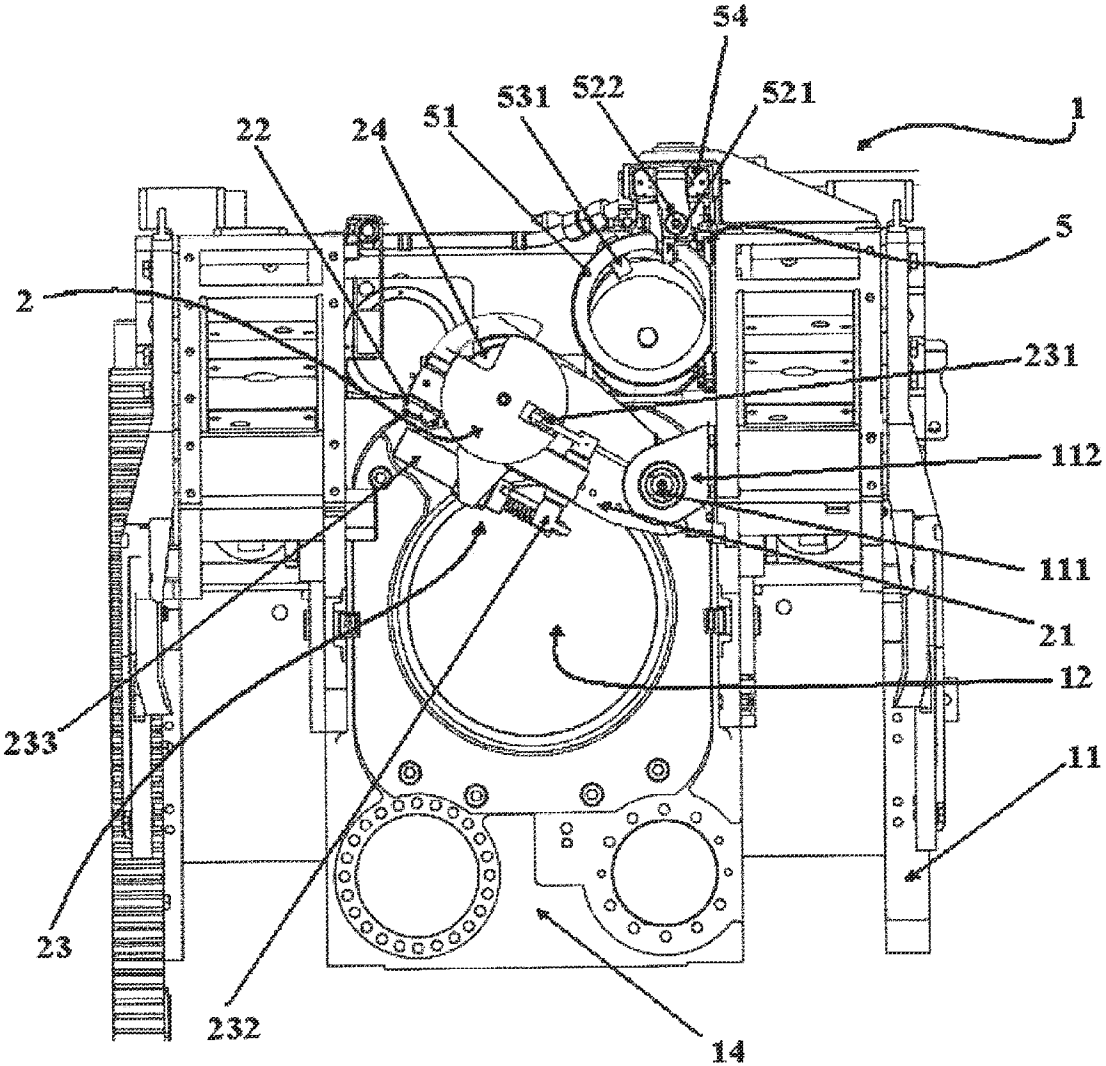
FIG. 5 illustrates a rear view of the system in position "B" applied onto a firearm.

Tray 2 is preferably circular-shaped, with dimensions such as to receive the cartridges from firearm 1, and during its rotation about axis "X" it can take up three different positions, as illustrated in FIG. 4.

In position "A" tray 2 is aligned with the axis of barrel 13 of firearm 1, waiting to receive the cartridge.

Position "B", defined as the safety position, is the position that tray 2 takes up in the case in which movement mechanism 3 malfunctions.

Said position "B" is also the intermediate position before returning into position "A".

Position "C" is the position that tray 2 takes up when it must be cleared of the cartridge it contained by an expulsion mechanism 5.

Once the cartridge has been expelled, tray 2 returns to the position "A" so as to receive a further cartridge.

As mentioned above, when passing from position "C" to position "A", tray 2 can, for example, stop in position "B" in the case in which the loading mechanism has not yet finished its operations, averting the possibility of collisions between the parts involved, to then return to position "A" once the loading mechanism has been disengaged.

As mentioned above, the rotary movement of tray 2 occurs around axis "X" through a hooking portion 21, preferably U-shaped, comprised in such a tray 2, which is hinged to a pin 111.

Such a pin 111 is fixed to box-shaped structure 11 through a support flange 112.

The movement of tray 2 is carried out by movement mechanism which comprises a double acting movement actuator 31, preferably hydraulic, dedicated to tray 2, which acts upon tray 2 itself, via a gear mechanism 32.

The movements of tray 2 can be synchronised, with the rest of the mechanisms implemented in firearm 1, in a preset and appropriately cadenced way from a first position "A", where the cartridge is received, to a second position "C", in which the cartridge is expelled by an expulsion mechanism 5, and vice versa.

In normal operation conditions of the evacuation system, when tray 2 receives the cartridge it is received inside tray 2 itself.

Said tray 2 must respect a certain distance from firing chamber 12 so as to avoid impacts during the recoil of firearm 1 following upon deflagration of the ammunition.

The position of tray 2 with respect to firing chamber 12, from which the cartridge comes, varies according to the angle of inclination of firearm 1.

The cartridge extracted from such a chamber 12 undergoes the effect of gravity differently according to the angle of inclination of firearm 1, and therefore tray 2 will be positioned correctly so as to be able to always receive the cartridge.

Tray 2 comprises a cartridge-retention device 22 and a braking device 23.

The cartridge arrives inside tray 2 with a certain speed suitable for the correct insertion into tray 2.

In the embodiment described, such a speed is moreover exploited so as to activate cartridge-retention device 22 which generates a signal of receiving the cartridge when the latter is inside tray 2.

In the illustrated embodiment, given as an example and not for limiting purposes, the cartridge is inserted inside tray 2 exploiting the recoil of firing chamber 12 consequent to the deflagration of the ammunition.

The receiving signal is received by a control device, which is suitable for controlling and activating the systems, mechanisms and devices present in firearm 1, which will activate movement mechanism 3.

Such a cartridge-retention device 22 comprises a contact portion 221 with the cartridge, adapted to detect the presence of the cartridge itself inside tray 2, sending the receiving signal to the control device.

In the following embodiment contact portion 221 is preferably a metallic element that is hinged so as to rotate around an axis, which is preferably perpendicular with respect to the longitudinal axis of the cartridge inserted in tray 2.

The rotation of contact portion 221, through a first lever mechanism, activates such a retention device 22, which transmits the signal of received cartridge to the control device.

Braking device 23 is adapted to slow down the cartridge, from firing chamber 12, in its insertion inside tray 2, preferably after sending the receiving signal towards the control device by cartridge-retention device 22.

Such a braking device 23 makes it possible to avoid collisions between the cartridge and the bottom of tray 2, in any case allowing retention device 22 to detect the presence of the cartridge inside tray 2.

Figure 6B:
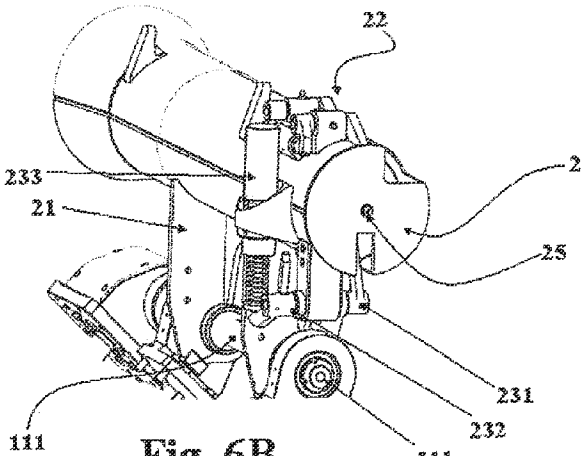
FIGS. 6A and 6B respectively show the cartridge-retention device (FIG. 6A) and the braking device (FIG. 6B), according to the present invention.
Figure 6A:
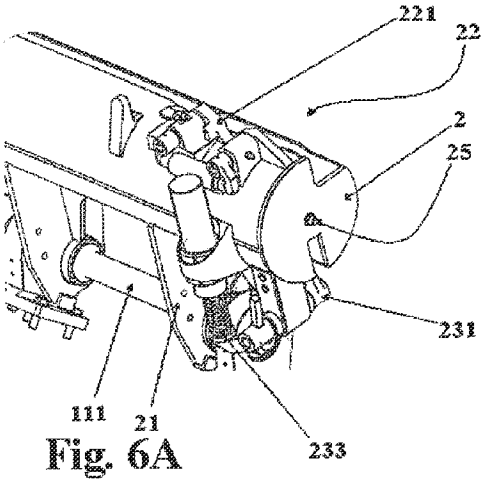
Figure 7:
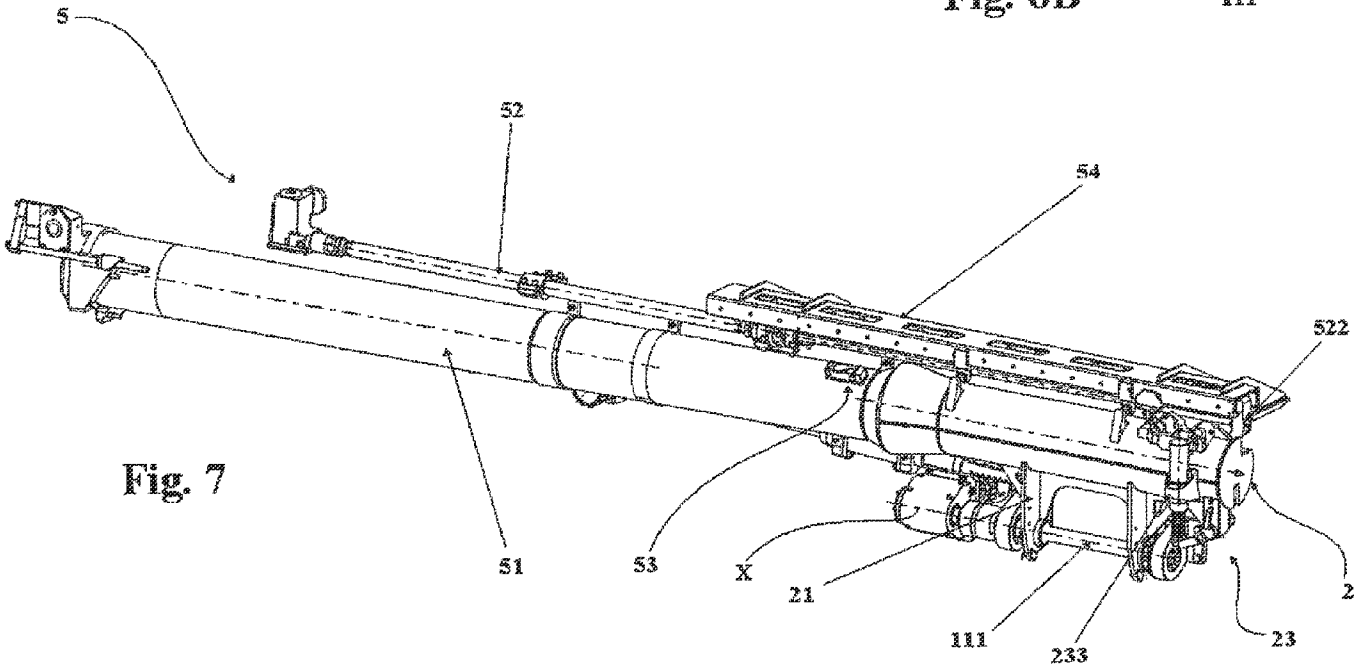
FIG. 7 illustrates the mechanism for expelling the cartridge with the tray in position "C"
Figure 9:
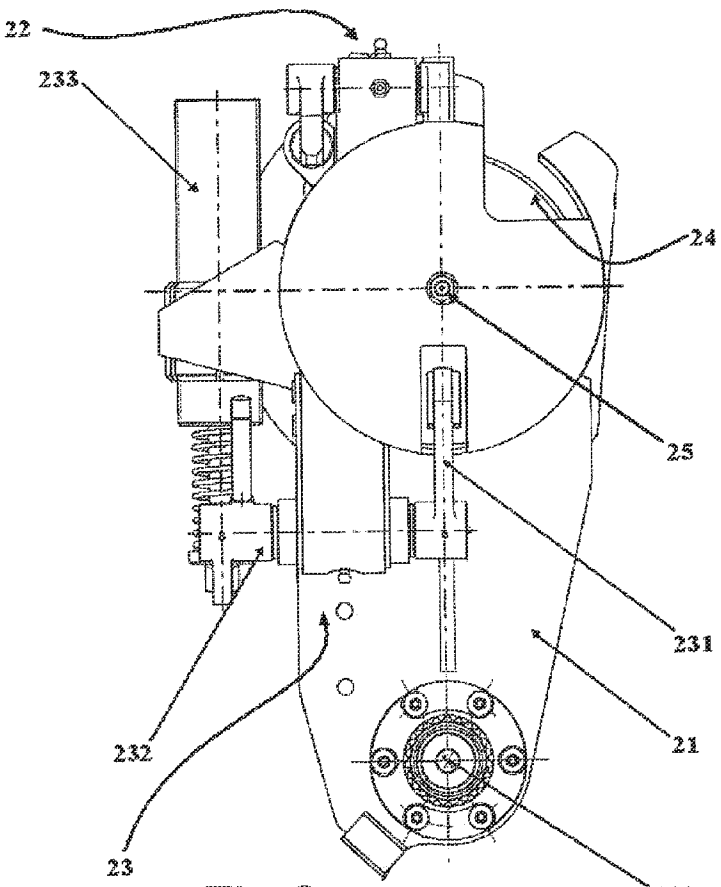
FIG. 9 illustrates the tray according to the present invention in a rear view.
Figure 8:
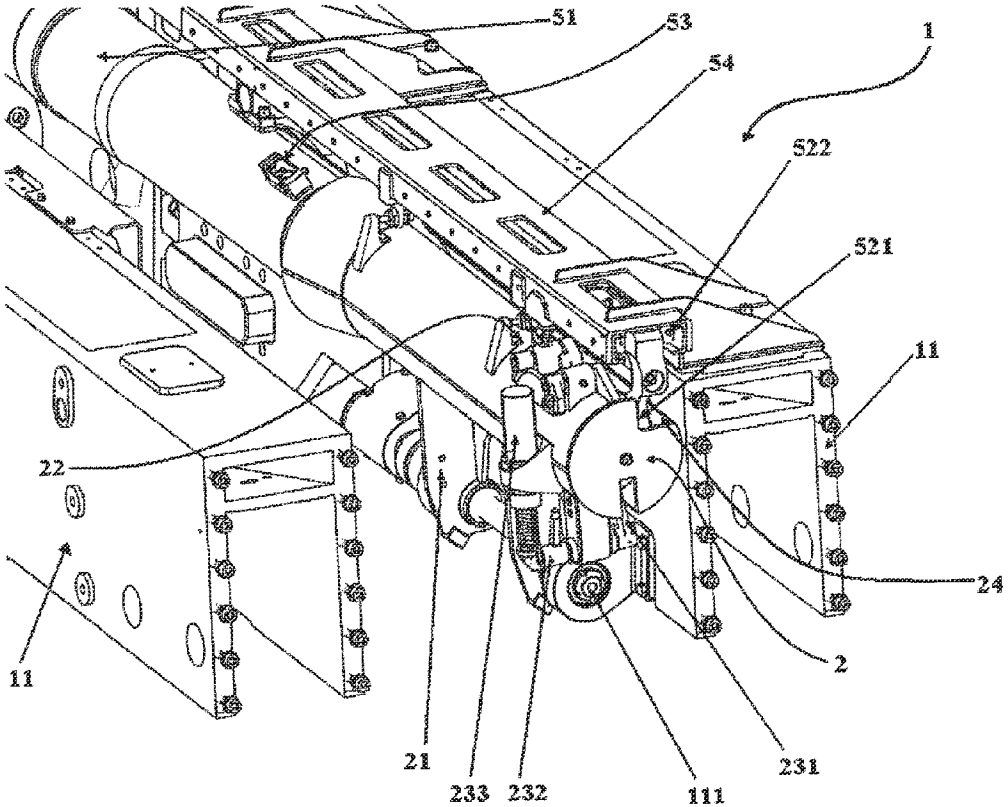
FIG. 8 illustrates a rear perspective view of the system for evacuating cartridges with the tray in position "C"

In embodiment illustrated in FIG. 6B, braking device 23 preferably comprises a contact plate 231, a second lever mechanism 232, connected to a damper 233.

Said plate 231, rotating around a pin with an axis that is preferably perpendicular to the longitudinal axis of the cartridge, comes into contact with the bottom of the cartridge and thanks to the lever mechanism, connected to damper 233, it slows down the cartridge.

A buffer 25, for example in rubber, is applied to the bottom of tray 2, said buffer being adapted to soften impacts of the cartridges if they have not been sufficiently slowed down by braking device 23.

When the receiving signal is received by the control device it activates movement mechanism 3, in a way such as to pass from position "A" to position "C" passing by position "B", which is preferably about half way between the other two positions.

With such a system, the firing frequency of firearm 1 is increased, since the different shooting steps of firearm 1 are carried out almost simultaneously.

In the illustrated embodiment, position "C" is preferably at a rotation of about 130° of tray 2 with respect to position "A"; consequently, position "B" is preferably at a rotation of about 60° of tray 2 with respect to position "A".

The movement of movement mechanism 3, on tray 2, is preferably decelerated when approaching stroke end, more precisely when approaching position "A" and in position "C", so as to avoid impact between parts, and so as to reduce oscillations of tray 2.

Such oscillations would be harmful, since they could propagate to the devices interacting with the evacuation system, making the system less stable.

Tray 2, once it has reached position "C", is freed from the cartridge that was previously contained in the tray itself, by expulsion mechanism 5, which comprises a rigid tube 51, adapted to channel the cartridge to be expelled, at least an expulsion actuator 52, preferably hydraulic, adapted to thrust the cartridge from tray 2 towards tube 51, through at least one thrust portion 521 comprised in actuator 52 itself.

Rigid tube 51 is preferably fixed above breech 14 so as to not get in the way of the various devices comprised in the firearm.

Said actuator 52 is placed in a position such as to not get in the way of the rotation of tray 2, preferably parallel to tube 51. It is supported above tray 2 through at least one support rod 54 preferably fixed both to tube 51 and to box-shaped structure 11.

Thrust portion 521, also positioned so as to not get in the way of the movement of tray 2, is fixed both to actuator 52 and to at least one sliding block 522 adapted to slide along a guide together with such a portion 521, along the support rod 54 when actuator 52 is activated.

When tray 2 is in position "C", aligned with tube 51, a signal for the expulsion positioning reaches the control device.

Once the control device has received the positioning signal, it activates actuator 52, which is in the point of maximum extension, moving portion 521, which is channeled in a slit 24 in tray 2.

Such a slit 24 is preferably formed along the entire length of tray 2, so as to allow thrust portion 521 to expel the cartridge from tray 2 itself more easily.

said portion 521 presses against the bottom of the cartridge thrusting it from tray 2 towards tube 51.

Expulsion mechanism 5 also comprises a further anti-return device 53, which activates in the case in which the thrust of actuator 52 on the cartridge is not enough to thrust it beyond tube 51.

said device 53 consists of a lock portion 531, which is placed inside tube 51 in the case in which the cartridge returns towards tray 2, because the thrust from actuator 52 was not strong enough to make it come out from tube 51.

Said device is advantageous in the case in which firearm 1 is at a high angle of inclination, in which the thrust of actuator 52 can be insufficient for the cartridge to pass beyond tube 51.

When the cartridge is expelled from th tray 2, the control device receives a signal of successful expulsion in this way giving tray 2 consent to return to position "A" so as to receive another cartridge.

The control device activates movement mechanism 3 so as to pass from position "C" to the position "A" passing by position "B".

When passing from the second position (C) to the first position (A) of tray 2, the control device, in the case in which the loading mechanism is still performing its operating steps, makes it possible for the loading mechanism to terminate its operating steps, before allowing movement mechanism 3 to make tray 2 return, to the first position (A), so as to receive a new cartridge.

In the following embodiment, before reaching position "A", in the aforementioned case, movement mechanism 3 is slowed down, once position "B" has been reached, by means of a bypass valve.

The movement from position "C" towards position "A" of tray is slowed down as much as possible allowing the loading mechanism to terminate its operating steps without causing interference or impacts between the various mechanisms.

The slowing down of the descent preferably occurs by reducing the pressure in an oleodynamic circuit connected to actuator 31 by opening the bypass valve.

A further embodiment foresees for example stopping tray 2 in position "B", staying in position "B" until the control device receives the signal of end of loading, from the loading mechanism.

Once such a command has been received, the control device activates movement mechanism 3 so as to bring tray 2 from position "B" towards position "A".

In the case in which movement mechanism 3 fails to operate the system for evacuating cartridges comprises a safety mechanism which is adapted to free tray 2, in position "A", from the resistance that actuator 31, by not operating, exerts on such a tray 2 making the movement of such a tray 2 idle around pin 111.

Said solution prevents such a tray 2 from getting in the way of the loading mechanism when new ammunition is to be loaded in firearm 1.

Said safety mechanism comprises at least one relief valve connected to the oleodynamic circuit that controls actuator 31.

Such a relief valve, preferably a maximum pressure valve, is activated only in the case in which the loading mechanism reaches a certain operating step without such a tray 2 being moved from position "A".

Going into details, when the loading mechanism presses against tray 2, the relief valve opens due to the increase in pressure inside the oleodynamic circuit of actuator 31 that opposes such a movement of tray 2.

The relief valve is opened, emptying out the oleodynamic circuit of actuator 31, since the limit pressure of such a valve is exceeded, preferably 20 Bar.

Once such a valve has been opened the oleodynamic circuit of actuator 31 is discharged making tray 2 idle in the movement around pin 111.

The operating steps of the loading mechanism, in the aforementioned case, do not stop but rather continue loading new ammunition.

In such a situation, tray 2 is physically moved, for example to position "B", by the structure of the loading mechanism, since tray 2 is free to move.

Tray 2 is kept in such a position until the loading mechanism terminates its operating steps after which tray 2 goes back down into position "A" since it is still idle.

After the projectile has been loaded in such a condition an alarm is activated by the control circuit which indicates malfunctioning of mechanism 3, the emptying out of the oleodynamic circuit of actuator 31 and the idle movement of tray 2.

Said solution makes it possible to move for example tray 2 into position "B" without causing irreparable damage due to the impact between mechanisms.

In alternative embodiments a safety actuator is also comprised which, connected to an oleodynamic circuit, moves tray 2, for example to position "C" or position "B", in the case of malfunctioning of movement mechanism 3, after the relief valve has released tray 2, exploiting for example part of the power of the loading mechanism.

With such a system for evacuating cartridges it is possible to increase the firing frequency of a firearm 1, since the step of evacuating the cartridge from firing chamber 12 is carried out almost simultaneously with the step of loading new ammunition by the loading mechanism.

With such an evacuation system, the step of loading a new projectile occurs with a very slight delay that corresponds to the time it takes the cartridge to come out summed to the time it takes tray 2 to reach position "B", since after such a position the system for evacuating cartridges does not get in the way of the loading mechanism.

REFERENCE NUMBERS

Firearm 1
Box-shaped structure 11
Pin 111
Support flange 112
Firing chamber 12
Barrel 13
Breech 14
Tray 2
Hooking portion 21
Cartridge-retention device 22
Contact portion 221
Braking device 23
Contact plate 231
Lever mechanism 232
Damper 233
Slit 24
Buffer 25
Movement mechanism 3
Movement actuator 31
Gear mechanism 32
Cartridge expulsion mechanism 5
Rigid tube 51
Expulsion actuator 52
Thrust portion 521
Sliding blocks 522
Anti-return device 53
Lock portion 531
Support rod 54

Position A
Position B
Position C
Axis X

The invention claimed is:

1. System for evacuating cartridges, applied to a firearm, said firearm comprising a breech, and a firing chamber in which a projectile to come out through a barrel having a barrel axis to come is fired; said evacuation system comprising an evacuation tray configured for receiving the cartridge following deflagration of an ammunition, and a movement mechanism configured to move said tray;

the movement mechanism turning the evacuation tray about an axis, parallel to the barrel axis of the firearm, in a preset and appropriately cadenced manner, passing from a first position where the cartridge is received, to a second position where the cartridge is expelled by an expulsion mechanism, and vice versa;

wherein the movement mechanism comprises a movement actuator for the evacuation tray, which acts via a gear mechanism on the tray, in such a way that the movement of the tray is synchronized with the rest of the mechanisms implemented in the firearm;

wherein, once the evacuation tray has reached the second position, the cartridge contained in the evacuation tray is disengaged by the expulsion mechanism, which comprises a rigid tube, adapted for channeling the cartridge for final expulsion of the cartridge, and at least one actuator configured for thrusting the cartridge from the evacuation tray towards the tube, via at least one thrust portion.

2. The system according to claim 1, wherein the system for evacuating the cartridges comprises a safety mechanism configured to move the evacuation tray in the event of malfunctioning of the movement mechanism, preventing onset of damage consequent upon the impact of the tray with the loading mechanism.

3. The system according to claim 1, wherein the movement mechanism is decelerated as the movement mechanism approaches stroke end to prevent impact and to reduce oscillations of the evacuation tray.

4. The system according to claim 1, wherein the evacuation tray comprises a cartridge-retention device configured for generating a signal of reception of the cartridge when the cartridge is in the tray.

5. The system according to claim 1, wherein the evacuation tray comprises a braking device configured for decelerating the cartridge coming from the firing chamber when the cartridge is entering the tray.

6. The system according to claim 1, wherein the expulsion mechanism comprises an anti-return device, including a blocking portion configured for interposing the anti-return device within the tube, in the case where the cartridge returns towards the evacuation tray.

7. The system according to claim 1, wherein in the passage from the second position to the first position of the evacuation tray, in the case where the loading mechanism is still performing the operating steps, the loading mechanism terminates the operating steps before the movement mechanism causes return of the tray to the first position to receive a new cartridge.

8. System for evacuating cartridges, applied to a firearm, said firearm comprising a breech, and a firing chamber in which a projectile to come out through a barrel having a barrel axis to come is fired; said evacuation system comprising an evacuation tray configured for receiving the cartridge following deflagration of an ammunition, and a movement mechanism configured for moving said tray;

the movement mechanism turning the evacuation tray about an axis, parallel to the barrel axis of the firearm, in a preset and appropriately cadenced manner, passing from a first position where the cartridge is received, to a second position where the cartridge is expelled by an expulsion mechanism, and vice versa;

wherein the system for evacuating the cartridges comprises a safety mechanism configured for moving the evacuation tray in the event of malfunctioning of the movement mechanism, preventing onset of damage consequent upon the impact of the tray with the loading mechanism;

wherein the safety mechanism comprises at least one relief valve, comprising an oleodynamic circuit connected to the actuator, which is activated, emptying said oleodynamic circuit, only when the evacuation tray is still in the first position when the loading mechanism reaches a given operating step, making the tray idle in rotation about a pin.

* * * * *